US005239844A

United States Patent [19]

Sos

[11] Patent Number: 5,239,844

[45] Date of Patent: Aug. 31, 1993

[54] LATCH NEEDLE FOR A LOOP-FORMING TEXTILE MACHINE

[75] Inventor: Siegmund Sos, Ebingen, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 986,566

[22] Filed: Dec. 7, 1992

[30] Foreign Application Priority Data

Dec. 19, 1991 [DE] Fed. Rep. of Germany ..... 4142003

[51] Int. Cl.[5] ..... D04B 35/04

[52] U.S. Cl. ..... 66/122; 66/121

[58] Field of Search ..... 66/116, 117, 121, 122, 66/123

[56] References Cited

U.S. PATENT DOCUMENTS

| | | | |
|---|---|---|---|
| 219,012 | 8/1879 | Peberdy | 66/122 |
| 1,032,613 | 7/1912 | Korndoerfer, Jr. | 66/122 |
| 1,163,296 | 12/1915 | Williams | 66/121 X |
| 4,791,794 | 12/1988 | Schmoll | 66/121 |

FOREIGN PATENT DOCUMENTS

| | | | |
|---|---|---|---|
| 271699 | 5/1912 | Fed. Rep. of Germany . | |
| 413459 | 5/1925 | Fed. Rep. of Germany . | |
| 1166919 | 4/1964 | Fed. Rep. of Germany | 66/121 |
| 3702019 | 9/1987 | Fed. Rep. of Germany . | |
| 862825 | 3/1941 | France | 66/117 |
| 25292 | 5/1963 | German Democratic Rep. | 66/121 |
| 165483 | 2/1934 | Switzerland . | |
| 229204 | 2/1925 | United Kingdom | 66/122 |

*Primary Examiner*—Clifford D. Crowder
*Assistant Examiner*—John J. Calvert
*Attorney, Agent, or Firm*—Spencer, Frank & Schneider

[57] ABSTRACT

A latch needle for a loop-forming textile machine includes a needle shank; a sawslot provided in the needle shank and being defined by two parallel-extending needle shank cheeks; a rivet traversing the sawslot and being rotatably supported in the needle shank; a needle latch pivotally disposed in the sawslot and having a latch spoon and a rivet-receiving bore; and an elongated spring element having a first end anchored in the needle shank and a second end extending into the sawslot. In the closed position of the needle latch the second end of the spring element is in a pressing engagement with a support surface of the needle latch and resiliently urging the needle latch into an intermediate opening position. The needle latch has an open-ended recess extending from an end of the needle latch remote from the latch spoon into the rivet-receiving bore. The needle latch has a wall face defining the open-ended recess at one side thereof and carrying the support surface. The rivet is rigidly affixed to the needle latch.

6 Claims, 2 Drawing Sheets

LATCH NEEDLE FOR A LOOP-FORMING TEXTILE MACHINE

CROSS REFERENCE TO RELATED APPLICATION

This application claims the priority of German Application No. P 41 42 003.9 filed Dec. 19, 1991, which is incorporated herein by reference.

BACKGROUND OF THE INVENTION

This invention relates to a latch needle for loop-forming textile machines and is of the type which has a needle shank and a needle latch pivotally supported in a sawslot of the needle shank by means of a transversely extending rivet. The needle latch has at one end a latch spoon (noucat) which, in the closed position of the latch, cooperates with the needle head. The latch blade is provided with a rivet-receiving bore and has a terminal portion which extends from the zone of the rivet-receiving bore to that end of the needle latch which is opposite from the latch spoon. The latch needle further has an elongated spring element which, in the zone of one of its ends, is anchored in the needle shank and projects into the sawslot with its other, free end. The spring element, at least in the closed position of the needle latch, extends over a support surface provided on the terminal portion of the latch blade. The needle latch is elastically urged into a partially open, intermediate position by means of the spring element.

A latch needle of the above-outlined type is disclosed in German Patent No. 3,702,019. The partially open intermediate position of the needle latch ensures during the casting-on of the knitting, that is, at the beginning of the knitting process or upon adding loops, an unimpeded insertion of the yarn into the needle head as it is explained in detail in the above-identified German patent. The needle latch is pivotally supported on the rivet which is accommodated in the rivet-receiving bore of the latch and which is formed by a cylindrical pin rotationally immobilized in corresponding bores provided in the needle shank cheeks laterally bounding the sawslot or is constituted by essentially cylindrical embossments provided in the needle shank cheeks and projecting into the rivet-receiving bore. To obtain a satisfactory operation of the needle latch, it has to be ensured that the end of the spring element securely cooperates with the support surface at the end portion of the needle latch. Since for ensuring an easy motion of the needle latch, between the rivet and the rivet-receiving (bearing) bore a certain bearing play is required, the latch blade has to be laterally guided in the sawslot with relative accuracy. In needles of small size which correspondingly have a small needle latch, the support surface for the end of the spring element is small as well, because it has to be ensured in any event that the rivet-receiving bore is surrounded on all sides by a sufficiently thick bearing shell. The exact positioning of the end of the spring element on such a small support surface of the needle latch is occasionally involved with difficulties in the mass manufacture and, as a result, the spring element with its end may miss the support surface. Such occurrences may lead to defects in the knitting and immediately render the latch needle useless.

SUMMARY OF THE INVENTION

It is an object of the invention to provide an improved latch needle of the above-outlined type in which, even if the needle is small, a highly satisfactory cooperation between the spring element and the needle latch is ensured without setting excessive requirements on manufacturing accuracy, particularly as concerns the sawslot.

This object and others to become apparent as the specification progresses, are accomplished by the invention, according to which, briefly stated, the latch blade has, in the zone of its terminal portion, an open-ended recess extending into the rivet-receiving bore. The support surface for the spring element is constituted by a face of the recess and further, the latch blade is rigidly connected with the rivet rotatably supported in the needle shank cheeks which bound the sawslot.

In the latch needle according to the invention, the needle latch and the rivet form a rigid, permanent, undetachable unit so that a lateral tilting or outward pivoting of the needle latch during the pivotal motion cannot take place to a damaging extent because the rivet stubs journalling in the bores of the needle shank cheeks may be fitted into the bores with small tolerances without a substantial technological input. Thus, no high requirements of accuracy need to be set for the longitudinal sawslot since the latter no longer needs to guide the latch blade laterally. Further, because of the rigid connection between the needle latch and the rivet the otherwise usual measures for holding the rivet captive in the needle shank cheeks may be dispensed with. By virtue of the fact that the provision of the recess in the end portion of the latch blade results in a partial removal of the bearing shell, the support surface for the end of the spring element may reach directly up to the rivet. As a result, even in needles of small size there is ensured a sufficiently large support surface for the spring element. It is to be noted, however, that the invention is not limited to small needles; it may find application in a functionally safe manner in needles of small sizes.

For example, German Patent No. 413,459 and U.S. Pat. No. 219,012 disclose latch needles in which the needle latch is provided with a slot-like recess extending into their bearing bore. These latch needles, however, are not provided with a spring element cooperating with the needle latch. The needle latch is pivotally mounted on a rivet fixedly attached to the needle shank. In one construction the open design of the latch eyelet has the purpose of ensuring a replaceability of the needle latch, while in the other construction the thin, plastically deformable latch blade is bent as an eyelet about the rivet formed as a single piece with the needle shank.

In the latch needle according to the invention, the recess in the zone of the end portion of the latch blade advantageously flares outwardly from the rivet-receiving bore; the opening angle of the recess edge is preferably about 60°. As a result, the end of the spring element and the end portion of the needle latch engage in a very advantageous manner, ensuring that the needle latch upon its pivotal motion from the intermediate position in the direction of the fully open position is entirely disengaged from the spring element throughout a large pivotal range.

Expediently, the recess is bounded by two legs of the end portion of the latch blade; the leg situated opposite the back of the latch blade carries on its inner face the support surface, while the leg which is opposite the support surface is shortened in the direction of the latch length. Advantageously, the shortened leg is rounded at its end.

The rivet may be fixedly attached to the latch blade in any known expedient manner. Simple manufacturing conditions are obtained when the latch blade is welded to the rivet by laser dot welding.

DESCRIPTION OF THE PREFERRED EMBODIMENT

Figure 1:
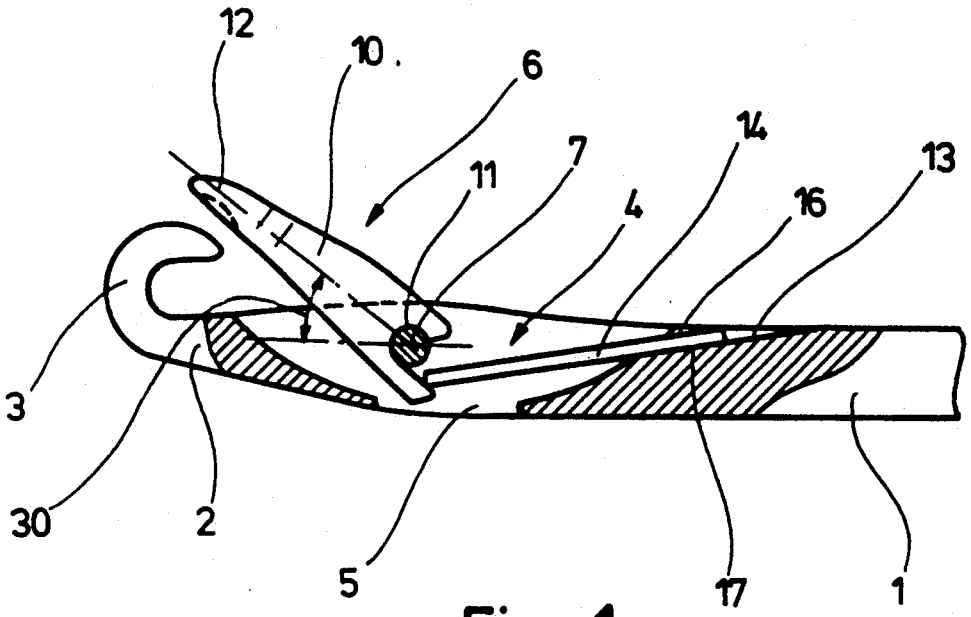
FIGS. 1-4 are sectional elevational views of a preferred embodiment of the invention depicted in four different operational positions.

Turning now to FIGS. 1-4, the latch needle according to the invention has a needle shank 1 which may carry a non-illustrated butt end adjoined by a needle head 3 at the needle throat 2. The needle shank 1 of rectangular cross section has a sawslot 4 which extends in the length dimension of the needle shank and which, starting from the upper side of the needle shank, extends to the lower side thereof in such a manner that at the underside of the needle shank an aperture 5 is provided for the discharge of lint.

In the sawslot 4, at a bearing location, a needle latch 6 is supported by means of a transversely extending rivet 7. The rivet 7 is formed as a cylindrical steel pin which is rotatably held with a small bearing clearance in aligned cylindrical bores 8 provided in the needle shank cheeks 9 which bilaterally bound the sawslot 4. The needle latch 6 has a latch blade 10 which is provided with a transversely extending, throughgoing bore 11 through which the rivet 7 passes. The needle latch carries at its end a latch spoon 12 which in the closed position of the needle latch cooperates with the needle head 3 as may be observed in FIG. 2.

In the needle shank 1, adjoining the sawslot 4, there is provided a groove-like depression 13 which starts at the upper side of the needle shank and extends in the length dimension thereof. A longitudinal spring element 14 is, at one of its ends, anchored in the depression 13 by caulking (deforming) and extends with its other end into the sawslot 4. In the illustrated embodiment the spring element 14 is a linear spring wire; it is to be understood that it may be a spring of circular, flat or rectangular configuration. As shown, it may be straight or it may be curved or have bent ends. The bottom 17 of the depression 13 is slightly inclined towards the underside of the needle shank such that the spring element end 15 lying in the sawslot 4 may be moved up and down without hindrance.

The latch blade 10 has in the zone between the rivet-receiving bore 11 and the end oriented away from the latch spoon 12 an elongated terminal portion 18 (FIG. 3) which forms, for the needle latch 6, a two-arm lever pivotally supported by the rivet 7. In the terminal portion 18 an open-ended recess 20 is provided which starts at the end face at 19 and extends up to the rivet-receiving bore 11 in such a manner that the bearing shell which surrounds the rivet 7 is removed in the zone of the open recess 20 on that side of the needle latch 6 which is remote from the latch spoon 12. The rivet-receiving bore 11 is, by means of the recess 20, open through a circumferential zone of approximately 120° as indicated at 21 in FIG. 3. The recess 20 proper, starting at the bore 11, flares outwardly in a wedge-like manner; the opening angle 22 of the recess is approximately 60°. The recess 20 forms in the end portion 18 of the needle latch 6 two legs 23 and 24 which bound the recess 20. The leg 23 which is opposite the back 25 of the needle blade 10 carries on its inner side which forms one part of the recess edge, a support surface 26 for the end 15 of the spring element 14. The support surface 26 is essentially planar and extends parallel to the frontal side 27 of the latch blade 10.

The leg 24 which is opposite the support surface 26 is shortened in the direction of the latch length. It is rounded at its end at 28 so that its inner surface which constitutes one part of the edge of the recess 22 is formed by a rounded zone 28 adjoining the back 25 of the latch blade 10.

The needle latch 6 is rigidly connected with the rivet 7. For this purpose the latch blade 10 is welded by means of laser dot welding to the rivet 7. The weld dots are designated at 29 in FIG. 4.

For assembling the above-described structure, after insertion of the cylindrical rivet 7 into the bores 8 of the needle shank cheeks 9, the needle latch 6 is inserted from above on the rivet 7 into a position in which its longitudinal axis forms an angle of approximately 90° with the longitudinal axis of the needle shank. Thereafter, laser welding takes place at 29 from below through the opening 5, whereby the needle latch 6 and the welded-on rivet 7 form an inseparable unit which is held captive by the bores 8 and the sawslot 4. The bearing clearance between the cylindrical rivet 7 and the cylindrical bores 8 is expediently so dimensioned that on the one hand there is ensured an easy mobility of the needle latch 6 and, on the other hand a lateral tilting or outward pivoting of the needle latch 6 during pivotal motion is prevented.

Figure 2:
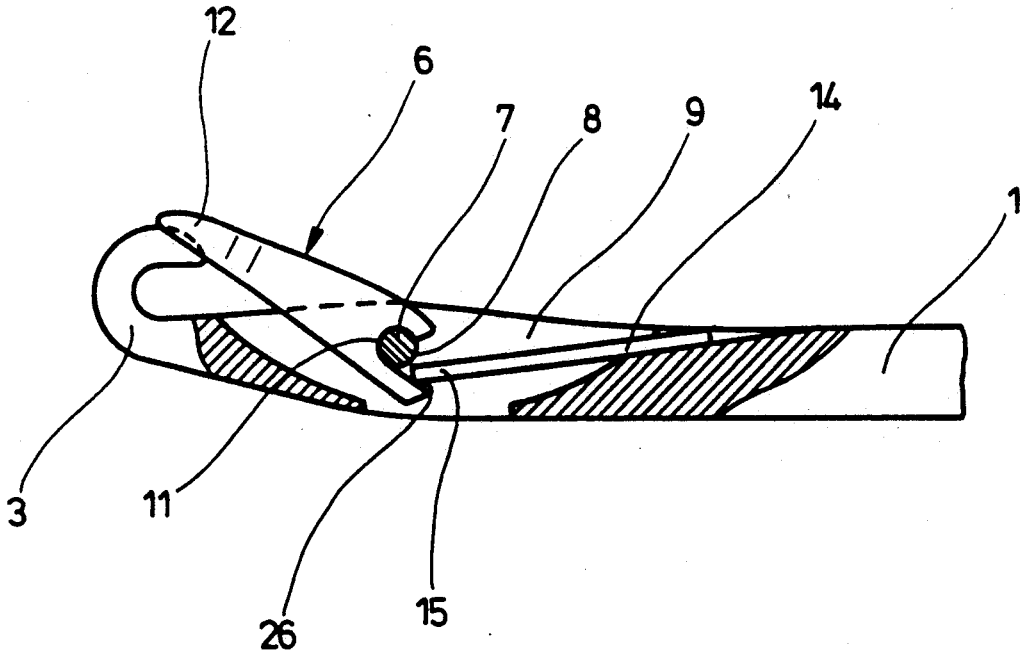

As particularly well seen in FIGS. 1 and 2, the length of the spring element 14 is so selected that the latter, when the needle latch 6 is in the closed position (FIG. 2), overlaps the support surface 26 of the latch end portion 18. At the same time, in the closed position of the needle latch 6 the spring element 14 is, as opposed to the relaxed state shown in FIG. 1, somewhat raised and thus biased at its end 15.

If, starting from the above-described closed position, the needle latch 6 is released, then it may move, urged by the biased spring element 14, into the partially open intermediate position show in FIG. 1 in which the longitudinal axes of the needle latch 6 and the needle shank 1 form an angle of approximately 30° with one another as designated at 30. The magnitude of this angle depends from the needle structure; in any event, the angle is always smaller than 90°.

Since the support surface 26, because of the recess 20, extends directly to the rivet 7 from the frontal face 19, it is sufficiently long even in needles of small sizes to ensure a secure engagement of the end 15 of the spring element 14.

Figure 3:
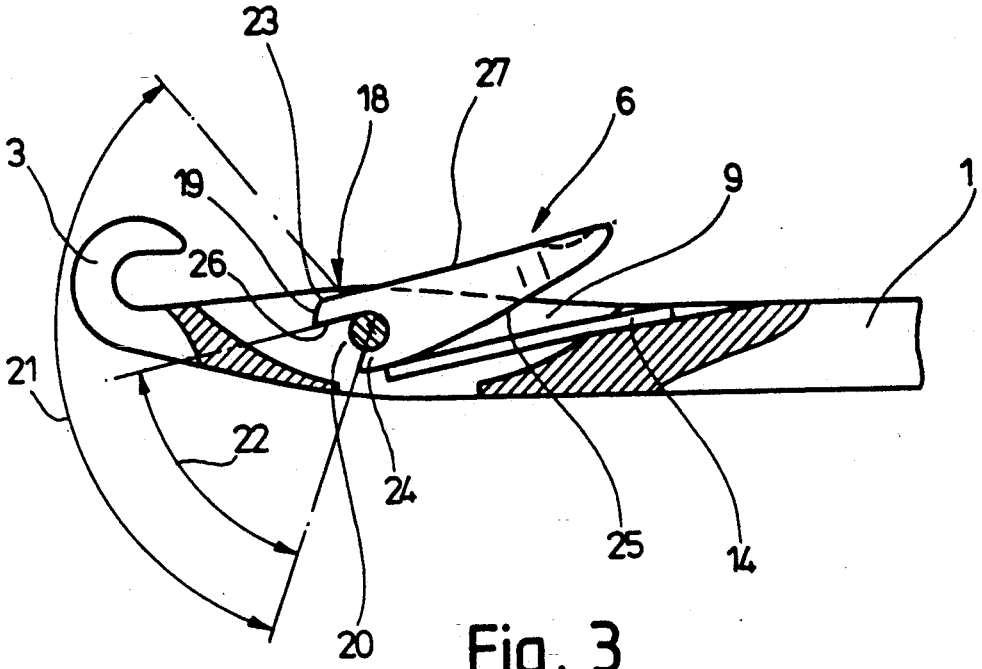
Figure 4:
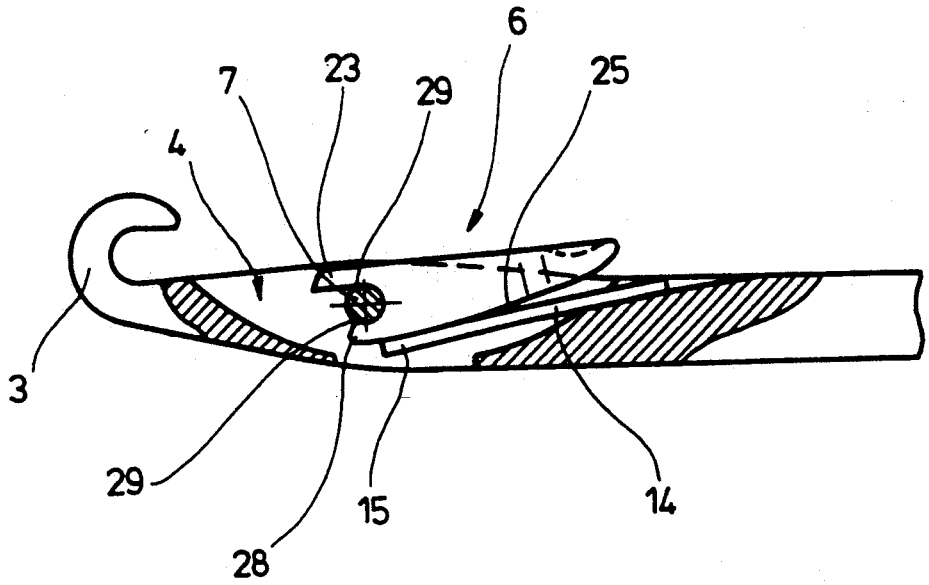

If during the loop-forming process the needle latch 6 is, by the loop suspended in the needle head 3, pivoted from the intermediate position shown in FIG. 1 clockwise in the direction of the fully open position as shown in FIG. 4, the support surface 26 is lifted off the end 15 of the spring element 14. Since the recess 20, starting at the rivet-receiving bore 11, flares as a funnel outwardly towards the front side 19 and since the second leg 24 which has a rounded end at 28 and which is situated opposite the support surface 26 has a correspondingly short dimension, the needle latch 6 may freely execute its entire pivotal motion from the intermediate position shown in FIG. 1 into the fully open position shown in FIG. 4 without being affected by the spring element 14. Only at the end of such a pivotal motion does the second leg 24, with its rounded end portion 28, engage the end 15 of the spring 14. Or, in the alternative, the structure is designed such that the needle latch 6 with the back 25 of its latch blade 10 immediately engages the spring element 14 as shown in FIG. 3. Upon continued outward movement of the latch needle, the needle latch 6, starting from the position shown in FIG. 3, is pressed downwardly by the loop that exerts force thereon so that the spring element 14 is slightly bent through as the needle latch 6 reaches its terminal position as shown in FIG. 4.

It will be understood that the above description of the present invention is susceptible to various modifications, changes and adaptations, and the same are intended to be comprehended within the meaning and range of equivalents of the appended claims.

What is claimed is:

1. In a latch needle for a loop-forming textile machine, including a needle shank terminating in a needle head;

a sawslot provided in the needle shank adjacent said needle head; said sawslot being defined by two parallel-extending needle shank cheeks;

a rivet traversing said sawslot and being supported in said needle shank;

a needle latch having an end provided with a latch spoon; said needle latch having a latch blade provided with a support surface and a rivet-receiving bore; said needle latch being situated in said sawslot and being pivotal by said rivet; said needle latch having a closed position in which said latch spoon is in engagement with said needle head;

an elongated spring element having a first end anchored in said needle shank and a second end extending into said sawslot; in said closed position of said needle latch said second end of said spring element being in a pressing engagement with said support surface and resiliently urging said needle latch into an intermediate opening position;

the improvement comprising (a) an open-ended recess extending in said needle latch from an end thereof remote from said latch spoon into said rivet-receiving bore; said needle latch having a wall face defining said open-ended recess at one side thereof and carrying said support surface;

(b) means for rigidly affixing said rivet to said needle latch; and (c) a bearing bore provided in each said cheek; said rivet extending into the bearing bores of said cheeks for journalling in said bearing bores.

2. The latch needle as defined in claim 1, wherein said open-ended recess flares outwardly from said supporting bore of said needle latch.

3. The latch needle as defined in claim 2, wherein said open ended recess has an opening angle of approximately 60°.

4. The latch needle as defined in claim 1, wherein said latch blade has a back situated opposite said latch spoon; further wherein said open-ended recess is formed by first and second legs of said needle latch extending in a length dimension of said needle latch; said first leg being situated opposite said back and having an inner face forming said support surface; said second leg being shorter in said length dimension than said first leg.

5. The latch needle as defined in claim 1, wherein said means for rigidly attaching said rivet to said needle latch comprises a weld.

6. The latch needle as defined in claim 5, wherein said weld is a laser dot weld.

* * * * *